United States Patent [19]

Myer

[11] Patent Number: 4,771,796

[45] Date of Patent: Sep. 20, 1988

[54] ELECTRICALLY OPERATED SIMULATED CIGARETTE

[76] Inventor: Fritz Myer, 2030 Rowland Ave., South East, Suite #104, Grand Rapids, Mich. 49506

[21] Appl. No.: 1,155

[22] Filed: Jan. 7, 1987

[51] Int. Cl.[4] ..... A24D 1/00; A24F 1/00; A24F 47/00

[52] U.S. Cl. ..... 131/273; 446/24

[58] Field of Search ..... 131/273; 446/24

[56] References Cited

U.S. PATENT DOCUMENTS 2,696,382 12/1954 Gelardin ..... 446/24

3,200,819 8/1965 Gilbert ..... 131/273

*Primary Examiner*—Vincent Millin

*Attorney, Agent, or Firm*—Samuel Kurlandsky

[57] ABSTRACT

A simulated cigarette having the appearance of an actual cigarette, comprising a body defining a housing having an axial chamber, one end of the body formed of a light-transmitting material simulating a cigarette ash and having an electric lamp mounted therein, a battery contained in the axial chamber electrically connected to the lamp, apertures radially arranged in the housing to permit air to be drawn into the axial chamber, an air-permeable filter in the axial chamber, an air passageway connecting one end of the chamber to the atmosphere for enabling air to be drawn out of the axial chamber, and rotary switch means connected in the circuit to the lamp for turning the lamp on and off by rotating one end of the simulated cigarette with respect to the other end.

6 Claims, 2 Drawing Sheets

ELECTRICALLY OPERATED SIMULATED CIGARETTE

BACKGROUND OF THE INVENTION

1. Field of the Invention

The present invention relates to smoking apparatus, and more particularly refers to a simulated smoking device designed to assist smokers in freeing themselves from the smoking habit.

2. Description of the Prior Art

In the recent past the midical profession and the public generally have come to realize that many health hazards are associated with smoking tobacco and especially smoking cigarattes. These hazards range from minor throat and lung irritations to emphysema and cancer. Even though the public have come to recognize these hazards, in many cases they have been unwilling or unable to drop the smoking habit. In some cases they have become addicted to nicotine as the result of years of slavery to the smoking habit. In other cases the smoker derives pleasure from holding a cigarette and drawing air through the cigarette.

Many forms of treatment and many physical devices have been developed in an attempt to help individuals to give up the smoking habit. In U.S. Pat. No. 4,184,496 a simulated cigarette is disclosed comprising a tubular device arranged for the individual to blow air through a tubular passage provided in the device. In U.S. Pat. No. 3,200,819 a simulated cigarette is disclosed wherein burning tobacco and paper are replaced with heated, moist flavored air. Additionally a medication may be placed in the tubular body. In the outer end of the tube is a flavor cartridge of an absorbent material. The inner-wall is shaped to provide air turbulence. Within the inner ring is a threaded electric socket having forwardly a battery cavity for receiving a battery having an inner contact and an outer contact with a contact strip between the inner contact and the socket. The heating element is a bulb having a screw plug for detachable engagement with the socket. The bulb is lit by turning it in the end socket after the end socket has been removed from the end of the main cartridge. Then the end socket is mounted on the end of the cartridge by screwing it into the threads thereof. Then when the bulb is to be turned off, the end socket must be unscrewed from the cartridge and the bulb unscrewed from the end socket U.S. Pat. No. 3,365,102 shows a simulated cigarette constructed to contain and dispense liquid beverages.

U.S. Pat. No. 3,631,856 discloses a simulated cigarette to provide a mixture of oxygen and a pleasant fragrance.

U.S. Pat. No. 4,429,703 discloses a simulated cigarette which may be filled with an aromatic substance to give a pleasant taste.

SUMMARY OF THE INVENTION

It is an object of the invention to provide an article which simulates a cigarette.

It is a further object of the invention to provide a simulated cigarette which permits air to be drawn through the simulated cigarette to give the sensation of smoking without drawing actual smoke through the device.

It is still further an object to provide a simulated cigarette having electrically operated means for providing a light at the end in the form of a glowing ash to more closely simulate the condition of actual smoking.

It is a primary object of the invention to provide a means for enabling a subject to break the smoking havit by simulating smoking without suffering the effects attendant complete withdrawal.

The foregoing and other objects, advantages and characterizing features of the invention will become apparent from the following description of certain illustrative embodiments thereof, considered together with the accompanying drawings, wherein like reference numerals signify like elements throughout the various figures.

According to the envention, a simulated cigarette is provided having the cylindrical appearance of an actual cigarette, formed of a cylindrical body having a housing defining an axial chamber with one end having a cap or receptacle formed of a light-transmitting material simulating a cigarette ash. An electric lamp is mounted in the cap and, when lit, causes the cap to have the appearance of a glowing cigarette ash. An electrical battery is contained in the axial chamber and is connected to the lamp by a circuit containing rotary switch means. A cigarette filter is contained within the axial chamber at the mouthpiece end. The lamp is turned on by rotating one end of the cigarette in relation to the other, causing the cigarette end to glow and the subject to simulate smoking.

DESCRIPTION OF THE PREFERRED EMBODIMENTS

Figure 1:
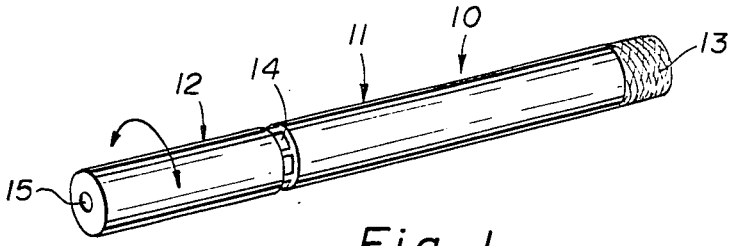
FIG. 1 is a perspective view of the simulated cigarette of the invention.
Figure 2:
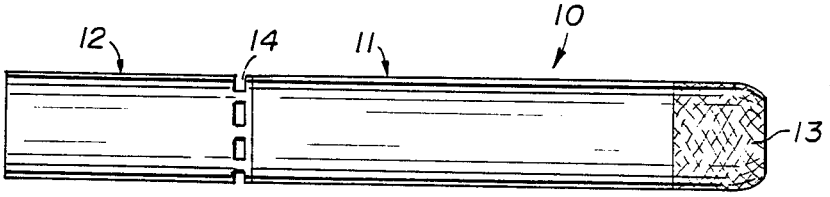
FIG. 2 is a side elevational view of the invention.

Referring to FIGS. 1 and 2, a simulated cigarette 10 according to one embodiment of the invention is shown comprising a main body member 11 and a mouthpiece member 12 rotatably mounted thereon. At the end of the main body member 11 is a simulated ash end cap or receptacle member 13, formed of a light-transmitting plastic or glass material which is transparant or translucent, and preferrably of a red or orange color. At the proximal end of the mouthpiece member 12 is a series of air intake ports 14. An air intake tube end 15 exits at the distal end of the mouthpiece member 12.

Figure 3:
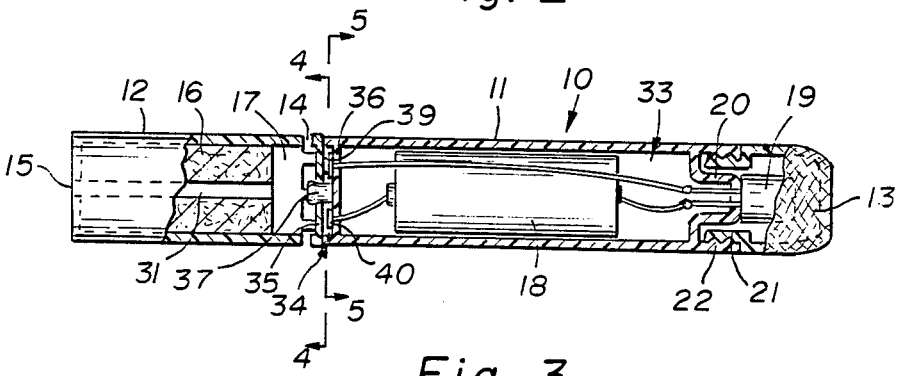
FIG. 3 is a side elevational view partly in section of the invention.

Referring to FIG. 3, the internal structure of the simulated cigarette 10 is shown and comprises a standard cigarette filter 16 having an axial tube 31 extending along its entire length. The filter 16 is mounted in an air filter chamber 17.

Mounted in an electrical battery chamber 33 is an electrical battery 18 such as one of the dry cell type. A lamp 19, which may be an incandescent lamp or a Light Emitting Diode type, is mounted on a lamp support 20.

It is retained in position by the cap or receptacle member 13 which in turn is affixed to the body member 11 by thread means 21 engaged in body thread means 22, or by snap or detent engagement means.

Figure 4:
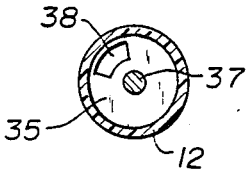
FIG. 4 is a cross-sectional view taken at the line 4—4, looking in the direction of the arrows.
Figure 5:
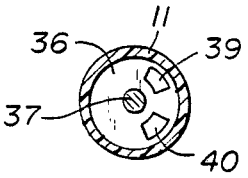
FIG. 5 is a cross-sectional view taken at the line 5—5, looking in the direction of the arrows.

Referring to FIGS. 4 and 5, rotary switch means 34 is shown comprising a mouthpiece member end wall 35 and a body member end wall 36. The end wall 35 and the end wall 36 are rotatably affixed together by an axial grommet or post 37. The end wall 35 is provided with a switch contact 38, and the end wall 36 is provided with switch contacts 39 and 40.

As shown in FIG. 3, a wire 44 connects one terminal of the battery 18 to one terminal of the lamp 19. Another wire 45 connects the other terminal of the lamp to the switch contact 39. A third wire 46 connects the other end of the battery 18 to the switch contact 40. In the embodiment shown the battery 18 remains permanently connected and the entire device is thrown away when the cell becomes exhausted, since the Light Emmitting Diode draws only a very small current and a dry cell battery therefore lasts a long time. Alternately a battery bracket may be placed in the cigarette device and the battery removed and replaced when necessary.

The simulated cigarette of the present invention as illustrated in the embodiment of FIGS. 1–5 is placed in operation by rotating the mouthpiece member 12 in relation to the body member 11. The switch contact 38 then completes the circuit across the switch contacts 39 and 40, thereby turning on the lamp and causing it to glow in simulation of the end of a burning cigarette. The subject then sucks on the mouthpiece member, causing air to be drawn in through the air intake ports 14. A portion of the air passes through the body of the filter and out through the tube end 15. Another portion of the air passes directly through the tube 31, the amount depending on the relative size of the tube. Utilizing the simulated cigarette in this fashion gives the subject some of the feeling and satisfaction of smoking without subjecting him to the harm which aas been proven to result from smoking. In time, the use of the cigarette of the invention may result in a substantial reduction in smoking and even in a complete withdrawal.

Figure 6:
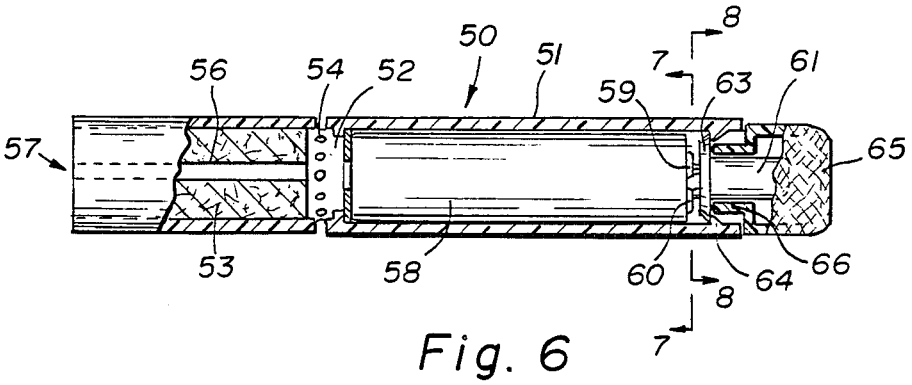
FIG. 6 is a side elevational view partly in section of another embodiment of the invention.
Figure 7:
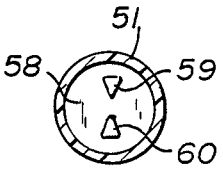
FIG. 7 is a cross-sectional view taken at the line 7—7 of FIG. 6, looking in the direction of the arrows.
Figure 8:
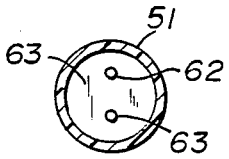
FIG. 8 is a cross-sectional view taken at the line 8—8 of FIG. 6, looking in the direction of the arrows.

Referring to FIGS. 6–8, a second embodiment of the invention is shown. In this embodiment a simulated cigarette 50 is shown having a single cylindrical body member 51. The body member 51 has an axial channel 52 containing a cigarette filter 53. A plurality of apertures 54 are provided in the wall of the body member 51 to permit air to be drawn into the axial channel 52. A tube 56 is provided in the filter 53, if desired, to facillitate the passage of air through the filter. An aperture or air outlet 57 is provided for air to be aspirated from the mouthpiece end of the cigarette.

An electrical battery 58 is mounted in the axial channel 52 having electrical terminals 58 and 59 mounted at one end of the battery. A Light Emitting Diode 61 having terminals 62 and a base plate 63 affixed thereto is mounted in the axial channel 52 and retained therein by a snap-in flange 64 serving as a detent operating against the rim of the base plate 63, which is urged against the flange 64 by the engagement of the terminals 62 against the end of the battery. A lens cap or receptacle 65 having a lens base 66 integral therewith is mounted over the Light Emitting Diode. It is maintained in place by adhesively affixing the lip of the lens base 66 to the base plate 63.

When the simulated cigarette of the invention is in non-operating condition the terminals of the Light Emitting Diode are at rest in contact with the insulated portion of the battery 58 and spaced-apart from the battery terminals 59 and 60. To place the cigarette in operation the lens cap or receptacle is grasped and rotated 90 degrees so that the terminals 62 are in contact with the terminals 59 and 60. Current from the battery 58 then flows through the Light Emitting Diode and causes the lens cap or receptacle to glow. The cigarette is then utilized in the same manner as that of the first embodiment described atove.

Although the invention has been described in connection with only specific embodiments thereof, it is evident that many alternatives, modifications, and variations will be apparent to those skilled in the art in the light of the forgoing description and drawings. Accordingly, it is intended to embrace all such alternatives, modifications and variations within the spirit and scope of the appended claims.

Invention is claimed as follows:

1. A simulated cigarette comprising a body having an axial chamber therein, an aperture at one end of said body for permitting air to be drawn out from said axial chamber, a filter positioned in said axial chamber adjacent said aperture, a plurality of apertures provided in the wall of said body for permitting air to pass into said chamber, an electrical battery mounted in said axial chamber, a receptacle formed of a light-transmitting material simulating a cigarette ash mounted at the other end of said body having a lamp mounted therein, and rotary switch means and associated circuitry electrically connecting said battery to said lamp, the ends of said body being rotatably mounted with respect to each other and so arranged that rotation of one end of said simulated cigarette with respect to said other end actuates said rotary switch and causes said lamp to be turned on or off, thereby permitting simulated smoking to take place when said lamp is turned on.

2. A simulated cigarette according to claim 1, wherein an axial passage is provided in said filter to facillitate passage of air therethrough.

3. A simulated cigarette according to claim 1, wherein said lamp is a Light Emitting Diode.

4. A simulated cigarette according to claim 1, wherein said body is comprised of two body members each having an axial channel, the first body member having said filter mounted therein, and said second body member having said battery mounted therein and said lamp and said receptacle mounted at one end thereof, and means rotatably connecting said two body members together, said rotary switch means comprising a pair of switch contacts mounted at the end of one of said body members and a shorting contact mounted at the end of the other of said body members.

5. A simulated cigarette according to claim 1, wherein said lamp is a Light Emitting Diode having a retaining flange affixed thereto and a pair of spaced-apart terminals extending therefrom, said Light Emitting Diode being rotatably retained with respect to said axial chamber by means of a snap-in flange engaging the retaining flange of said Light Emitting Diode, and wherein said receptacle is affixed with respect to said retaining flange, whereby rotation of said receptacle causes the terminals of said Light Emitting Diode to make contact with the contacts at the end of said battery and said Light Emitting Diode to light up.

6. A simulated cigarette according to claim 5, wherein said receptacle is adhesively affixed to said retaining flange.

* * * * *